US005638340A

United States Patent [19]

Schiefele

[11] Patent Number: 5,638,340

[45] Date of Patent: Jun. 10, 1997

[54] CLOCK HAVING MAGNETICALLY-LEVITATED PENDULUM

[76] Inventor: Walter P. Schiefele, 1362 SW. Damask La., Sebastian, Fla. 32958

[21] Appl. No.: 632,100

[22] Filed: Apr. 15, 1996

[51] Int. Cl.[6] ..... G04B 17/02; G09F 19/00

[52] U.S. Cl. ..... 368/179; 368/223; 40/426; 40/485

[58] Field of Search ..... 368/76, 134, 179, 368/223, 225, 228, 229; 40/426, 485; 310/12, 13, 14, 90.5

[56] References Cited

U.S. PATENT DOCUMENTS

| | | | |
|---|---|---|---|
| 2,566,221 | 8/1951 | Lovell . | |
| 4,585,282 | 4/1986 | Bosley | 308/10 |
| 4,712,925 | 12/1987 | Beebe | 368/179 |
| 4,723,232 | 2/1988 | Beebe | 368/76 |
| 4,723,233 | 2/1988 | Beebe | 368/73 |
| 5,159,583 | 10/1992 | Lee | 368/223 |
| 5,168,183 | 12/1992 | Whitehead | 310/12 |

*Primary Examiner*—Vit W. Miska
*Attorney, Agent, or Firm*—George J. Seligsohn

[57] ABSTRACT

An analog or digital clock having a ferromagnetic pendulum that is magnetically levitated under feeedback-control and that, alternatively, may be (1) driven at a forced oscillation frequency which is decoupled from and asynchronous with the clock's time control element (e.g., a quartz crystal), (2) driven at a forced oscillation frequency which is coupled to and synchronous with the clock's time control element or (3) oscillated at the resonant frequency of the levitated pendulum and this resonant frequency is used as a time control for determining the clock's timing. Such a levitated pendulum clock is useful for both ornamental and educational purposes.

19 Claims, 13 Drawing Sheets

CLOCK HAVING MAGNETICALLY-LEVITATED PENDULUM

BACKGROUND OF THE INVENTION

1. Field of the Invention

This invention relates to clocks employing pendulums and, more particularly, to a clock employing a physically detached pendulum which is magnetically levitated by means of feedback control.

2. Description of the Prior Art

Clocks which employ an oscillating pendulum physically attached to the clock mechanism, wherein the pendulum operates as the time-control element, are notoriously old. More recently, pendulum clocks have been developed wherein the time-control element comprises a quartz crystal and a physically attached oscillating pendulum is employed solely for ornamental purposes.

The art also includes mechanisms for magnetically levitating a ferromagnetic object (which may or may not be permanently magnetized), as well as controlling the spatial position of such a magnetically levitated object.

Further, the art includes a magnetically-levitated pendulum bob, disclosed in U.S. Pat. No. 2,566,221 of W. V. Lovell. Lovell describes an aluminum/copper ball which is levitated by means of magnetic induction. This ball exhibits translatory motion, which would permit the bob to be used as a pendulum. However, magnetic induction based on eddy currents and magnetic repulsion is electrically inefficient. The currents reported by Lovell are simply too high for use in making a practical clock pendulum which is safe for home use.

In addition, the art includes a pendulum clock in which the pendulum is a float disposed in a liquid, disclosed in U.S. Pat. No. 5,159,583 of Lee. This float is oscillated by means of an electromagnet.

SUMMARY OF THE INVENTION

The present invention is directed broadly to either an analog or a digital clock employing a magnetically-levitated oscillating pendulum employing a feedback controller for levitation control. The magnetically-levitated oscillating pendulum may be used solely for ornamental purposes, wherein the magnetically-levitated oscillating pendulum is decoupled from the clock time-control element (which may be a quartz crystal) and oscillates at an asynchronous frequency with respect to the frequency controlled by the clock time-control element. However, alternatively, (1) the magnetically-levitated oscillating pendulum may be coupled to the clock time-control element (which may be a quartz crystal) and oscillate at a frequency which is synchronized by the frequency controlled by the clock time-control element or (2) the magnetically-levitated oscillating pendulum itself may be used as the clock time-control element. In this case, levitated oscillation of the pendulum is achieved by means of a position sensor and feedback control of an electromagnet.

DESCRIPTION OF THE PREFERRED EMBODIMENTS

Figure 1:
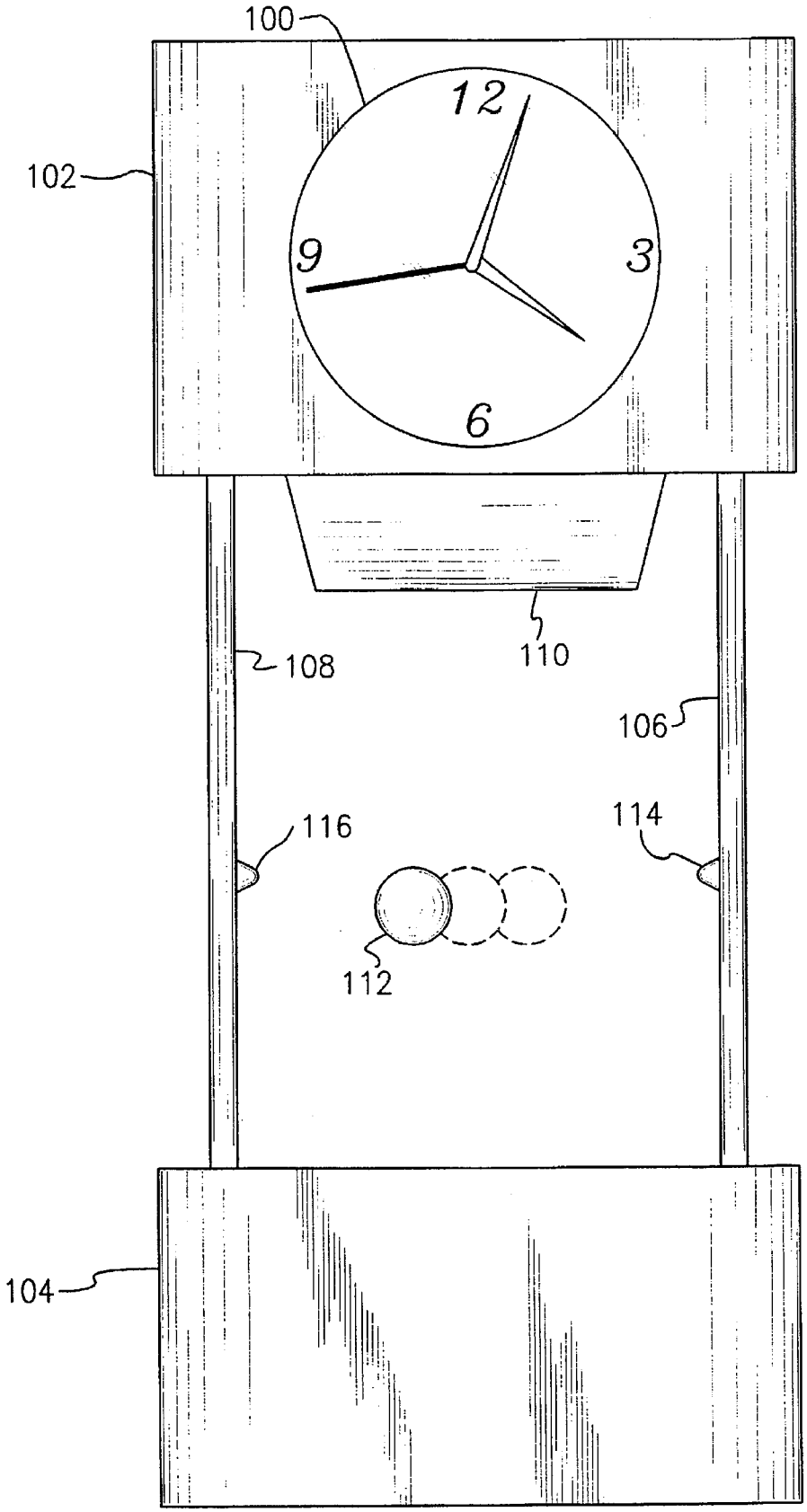
FIG. 1 illustrates an example of an analog clock utilizing a magnetically-levitated oscillating pendulum that operated in accordance with the principles of the present invention.

Referring to FIG. 1, there is shown analog clock face 100 of clockwork housing 102 supported on base 104 by tubular posts 106 and 108. Attached to clockwork housing 102 is housing 110 containing magnet and and other mechanisms, including control electronics (described in detail below), required to both magnetically levitate and oscillate ferromagnetic ball 112 (ferromagnetic ball 112 being preferably permanently magnetized). Further, shown in FIG. 1 is a light emitter, which may comprise a light-emitting diode (LED) 114, attached to tubular post 106 at a given height above base 104 and light-detector 116, which may comprise a phototransistor, attached to tubular post 108 at substantially the same given height above base 104. LED 114, which is energized through wires (not shown) extending through tubular post 106 from a power supply within base 104, emits a substantially horizontal light beam which is partially interrupted by ball 112. Light-detector 116 derives a signal in accordance with the intensity of the non-interrupted portion of this horizontal light beam reaching it. This signal is forwarded through wires (not shown) extending through tubular post 108 as a feedback input to the control electronics in housing 110 for controlling the strength of the magnetically levitating field depends on the height of magnetically-levitated ball 112 above base 104. Thus, if the strength of the magnetically levitating field is too small, so that ball 112 tends to drop under gravitational force, the non-interrupted portion of this horizontal light beam reaching light-detector 116 increases to thereby strengthen the magnetically levitating field and prevent such tendency to drop. However, if the strength of the magnetically levitating field is too large, so that ball 112 tends to rise under the force of the magnetically levitating field, the non-interrupted portion of this horizontal light beam reaching light-detector 116 decreases to thereby weaken the magnetically levitating field and prevent such tendency to rise. The circuitry of the operating mechanism for the clock of FIG. 1 is described in more detail below.

Figure 2:
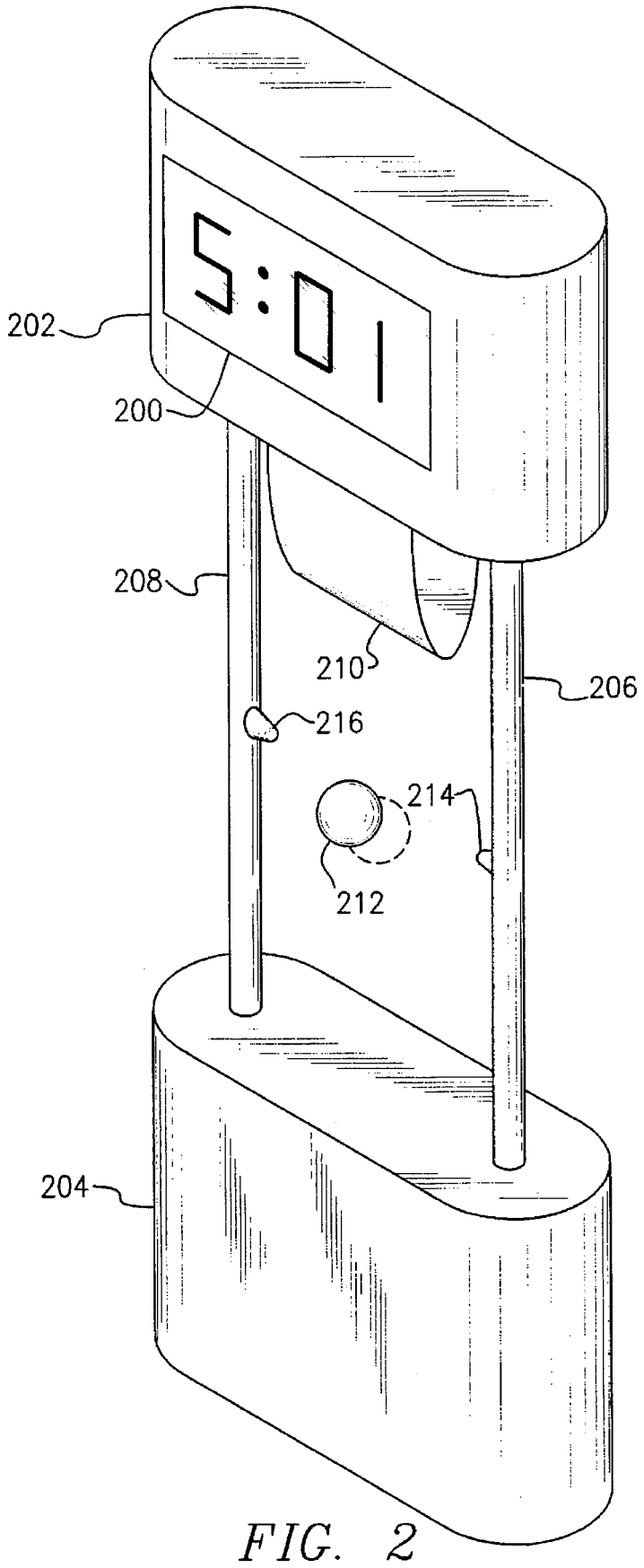
FIG. 2 illustrates an example of a digital clock utilizing a magnetically-levitated oscillating pendulum that operates in accordance with the principles of the present invention.

Referring to FIG. 2, there is shown digital clock face 200 of clock housing 202 supported on base 204 by tubular posts 206 and 208. In structure and function, each of elements 210, 212, 214 and 216 of FIG. 2 substantially corresponds, respectively, to each of elements 110, 112, 114 and 116 of FIG. 1.

Figure 3A:
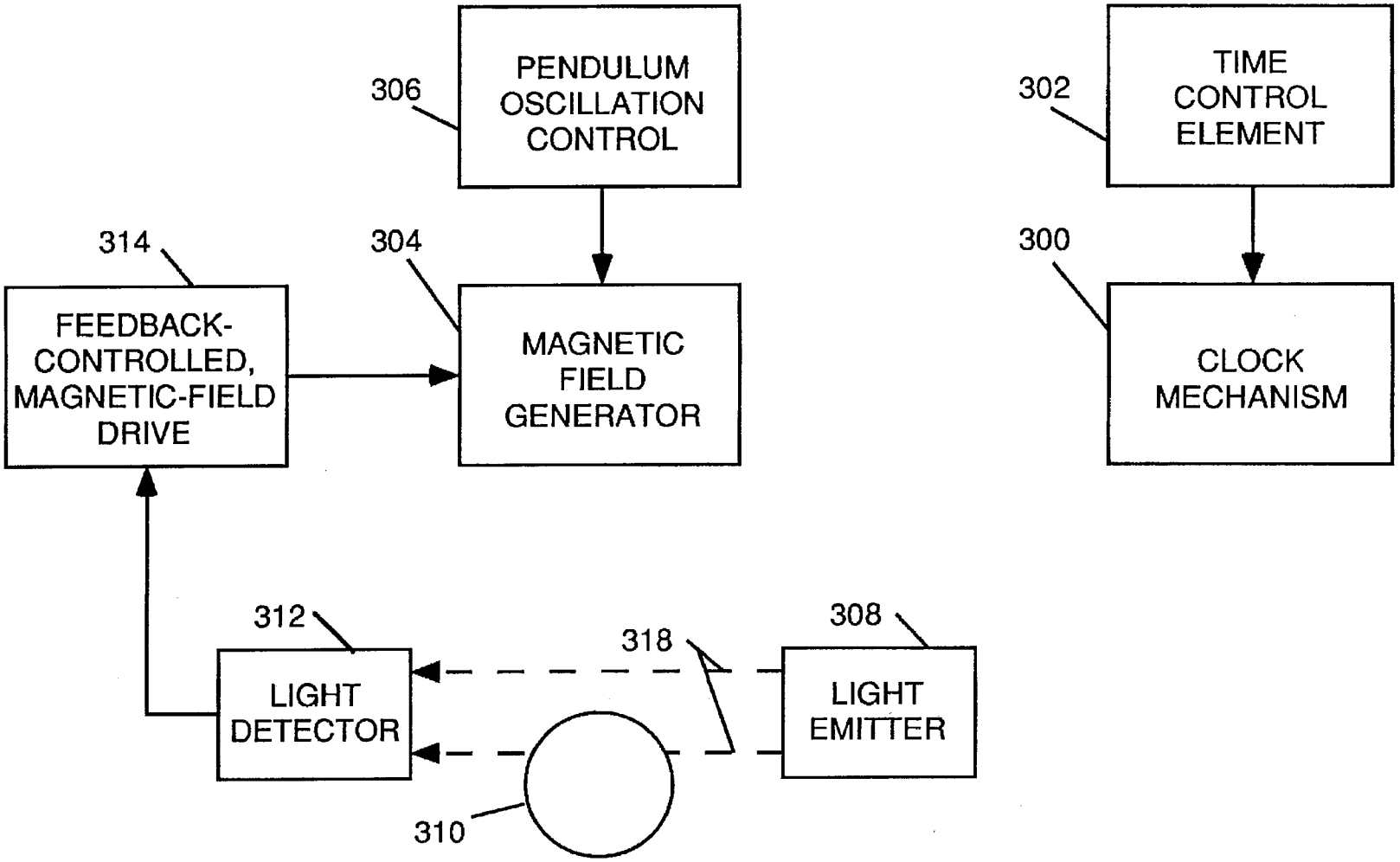
FIG. 3*a* is a functional block diagram of a first embodiment of the present invention.
Figure 3B:
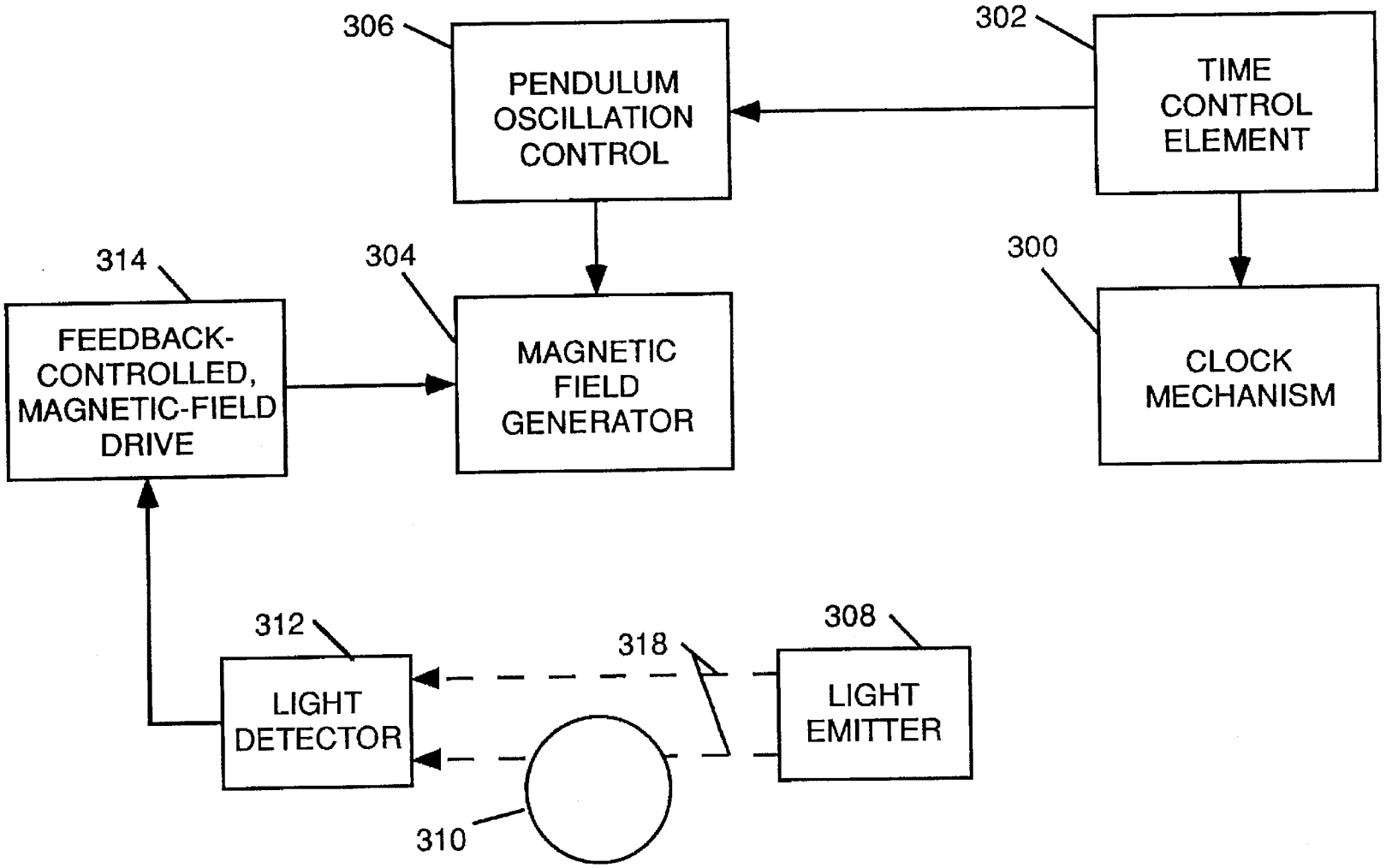
FIG. 3*b* is a functional block diagram of a second embodiment of the present invention.

Referring to FIGS. 3*a* and 3*b*, there are shown respective functional block diagrams of first and second embodiments of the present invention all of which comprise clock mechanism 300 (which may be either an analog or a digital clock mechanism) and time control 302, together with oscillating levitated pendulum structure that includes magnetic field generator 304, pendulum oscillation control 306, light emitter 308 (an example of which is an LED structure shown in FIG. 4*a*), oscillating levitated pendulum ball 310, light detector 312 (an example of which is a phototransistor structure shown in FIG. 4*b*) and feedback-controlled magnetic-field drive 314.

In the FIG. 3*a* first embodiment, which is employed solely for ornamental purposes, the timing of clock mechanism 300 is controlled by time control element 302 and clock mechanism 300 together with its time control element 302 is independent of and decoupled from the oscillating levitated pendulum structure. If clock mechanism 300 is analog, time control element 302 may include a quartz crystal and suitable frequency dividers for controlling the stepping motor of clock mechanism 300, as known in the art. However, if clock mechanism 300 is digital, time control element 302 may include a quartz crystal and suitable frequency dividers for controlling the digital display of clock mechanism 300, as also known in the art.

The FIG. 3*b* second embodiment is similar in structure to that of the FIG. 3*a* first embodiment, except that time control 302 is coupled to pendulum oscillation control 306, as well as clock mechanism 300, for driving the frequency of pendulum oscillation in synchronism with that of the time control of clock mechanism 300.

Figure 3C:
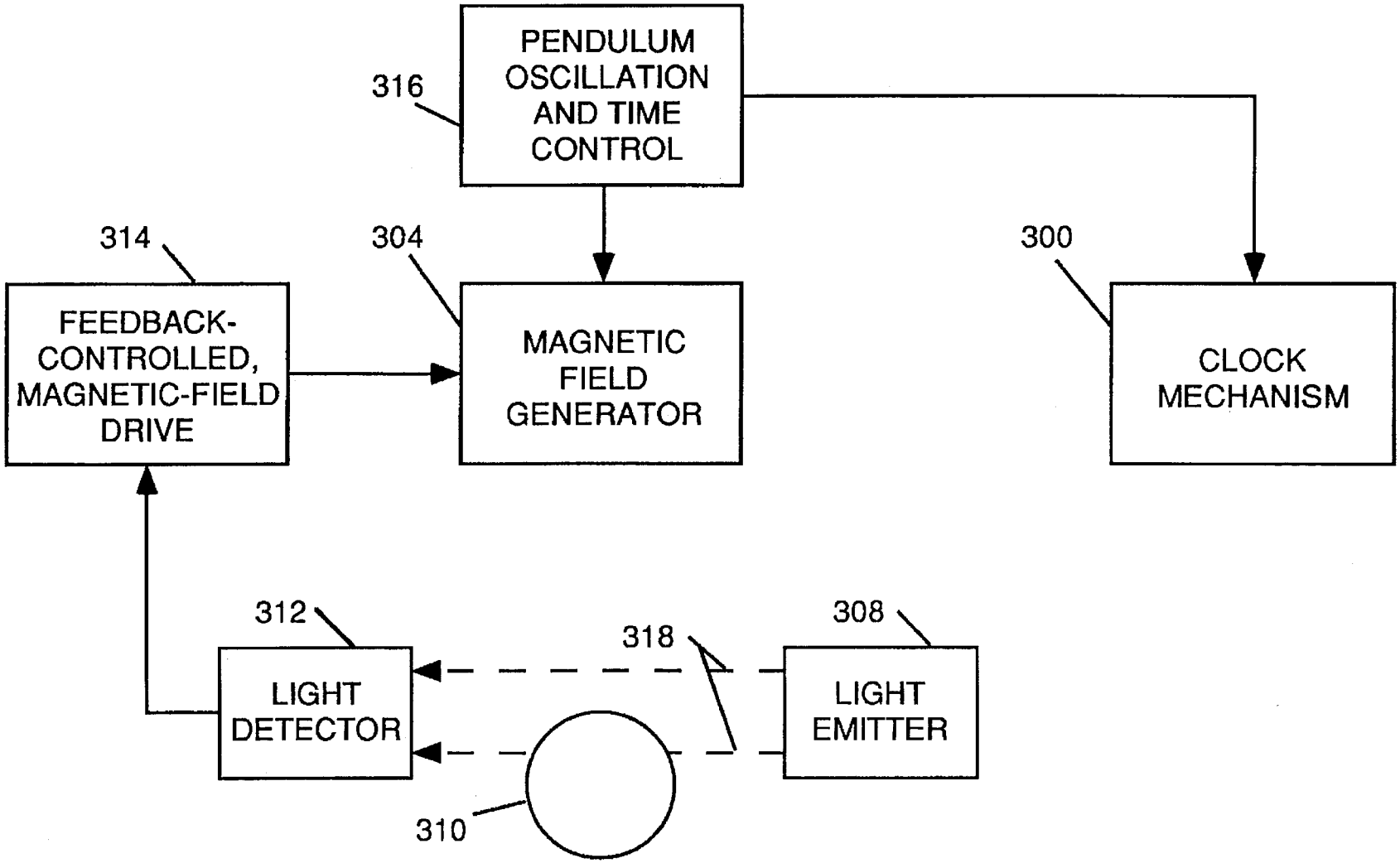
FIG. 3*c* is a functional block diagram of a third embodiment of the present invention.

The FIG. 3*c* third embodiment differs from both the FIG. 3*a* first embodiment and FIG. 3*b* second embodiment by substituting pendulum oscillation and time control 316 for time control element 302 and pendulum oscillation control 306. In, the case of the FIG. 3*c* third embodiment, the resonant frequency of oscillating levitated pendulum ball 310 provides the time control for clock mechanism 300, rather than the frequency of oscillation of ball 310 being forced by an external driving frequency.

Figure 5A:
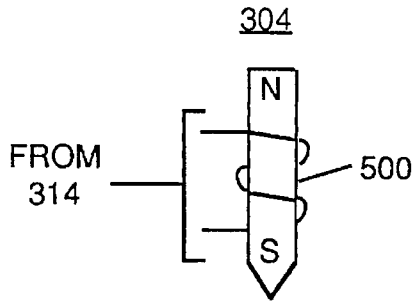
FIGS. 5*a*, 5*b*, 5*c* 5*d*, 5*e* and 5*f* illustrate examples of different structural forms of the magnetic field generator, a selected one of which is employed in each of the embodiments of FIGS. 3*a*, 3*b* and 3*c;*

Magnetic field generator 304 at the least includes electromagnetic means (such as shown in FIG. 5*a* or preferably in FIG. 5*b*) for generating the magnetic field for levitating ball 310. Ball 310 comprises of a ferromagnetic material (preferably permanently magnetized and having the form shown in FIG. 6). The light of a cylindrical beam of light 318 emitted by light emitter 308 and directed toward light detector 312 is partially occluded by levitated ball 310, thereby decreasing the intensity of light reaching light detector 312 and, hence, the signal level of its output. For illustrative purposes, the effective width of cylindrical light beam 318 shown in FIGS. 3*a*, 3*b* and 3*c* is exaggerated. The actual effective width is determined by the aperture of light detector 312. The output of light detector 312 is fed back through drive 314 (which may take the form shown in FIG. 7*a* or FIG. 7*b*) to energize the electromagnetic means for generating the magnetic field for levitating ball 310. Specifically, any tendency for ball 310 to drop under the influence of gravity or, alternatively, to rise under the influence of the upward force of the magnetic levitating field from an equilibrium position in cylindrical light beam 318 causes a consequent increase or decrease in the intensity of light reaching light detector 312, thereby resulting in an adjustment in the strength of the magnetic levitating field which restores ball 310 to its equilibrium position.

Figure 8:
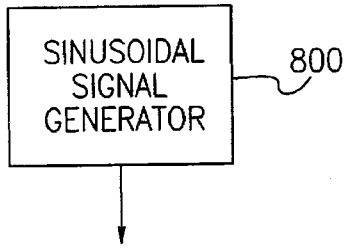
FIG. 8 illustrates the preferred form of the pendulum oscillation control employed in the first and second embodiments of FIGS. 3*a* and 3*b;*

In the case of the FIG. 3*a* first embodiment and FIG. 3*b* second embodiment, pendulum oscillation control 306, in principle, can merely be mechanical means, such as a rack and pinion, for laterally oscillating the levitating electromagnetic means of generator 304 back and forth between left and right, thereby causing a corresponding oscillation of ball 310. In this case, generator 304 comprises only the electromagnetic means of FIG. 5*a* or, alternatively, FIG. 5*b*. However, it is preferable to accomplish such lateral oscillation by modifying the magnetic field generated by generator 304 in the manner shown by the electromagnetic means of FIG. 5*c* or FIG. 5*d* (which includes both a levitating magnet and at least one auxiliary electromagnet energized by sinusoidal signal generator 800, shown in FIG. 8. Signal generator 800 constitutes a species of pendulum oscillation control 306. In the case of the FIG. 3*a* first embodiment, sinusoidal signal generator 800 is free running at an appropriate oscillating frequency. Alternatively, in the case of the FIG. 3*b* second embodiment, the frequency of sinusoidal signal generator 800 is synchronized by time control element 302.

Figure 5C:
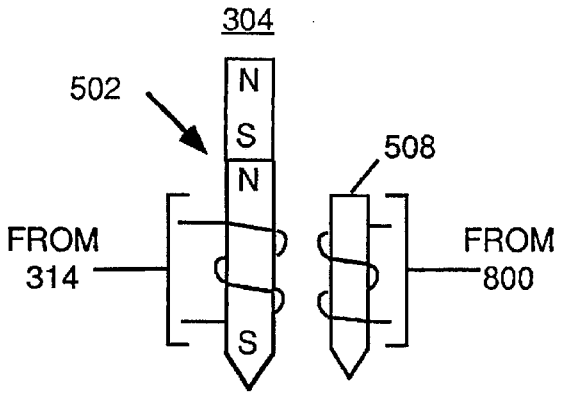
Figure 5B:
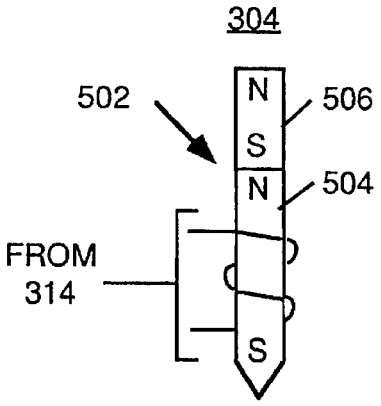
Figure 5D:
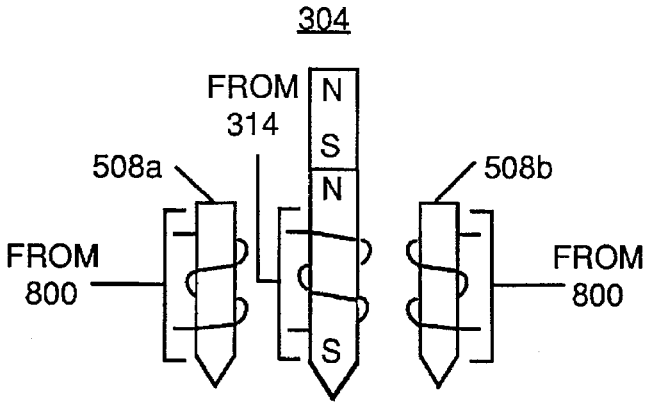
Figure 5E:
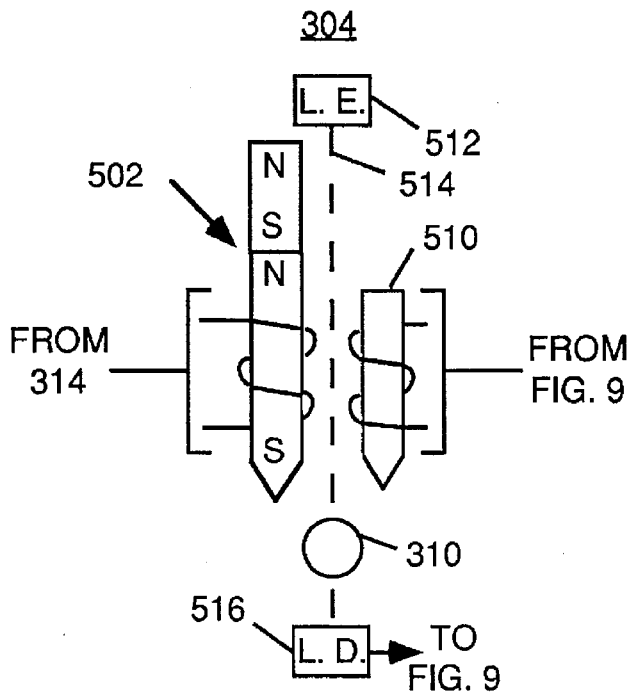
Figure 9:
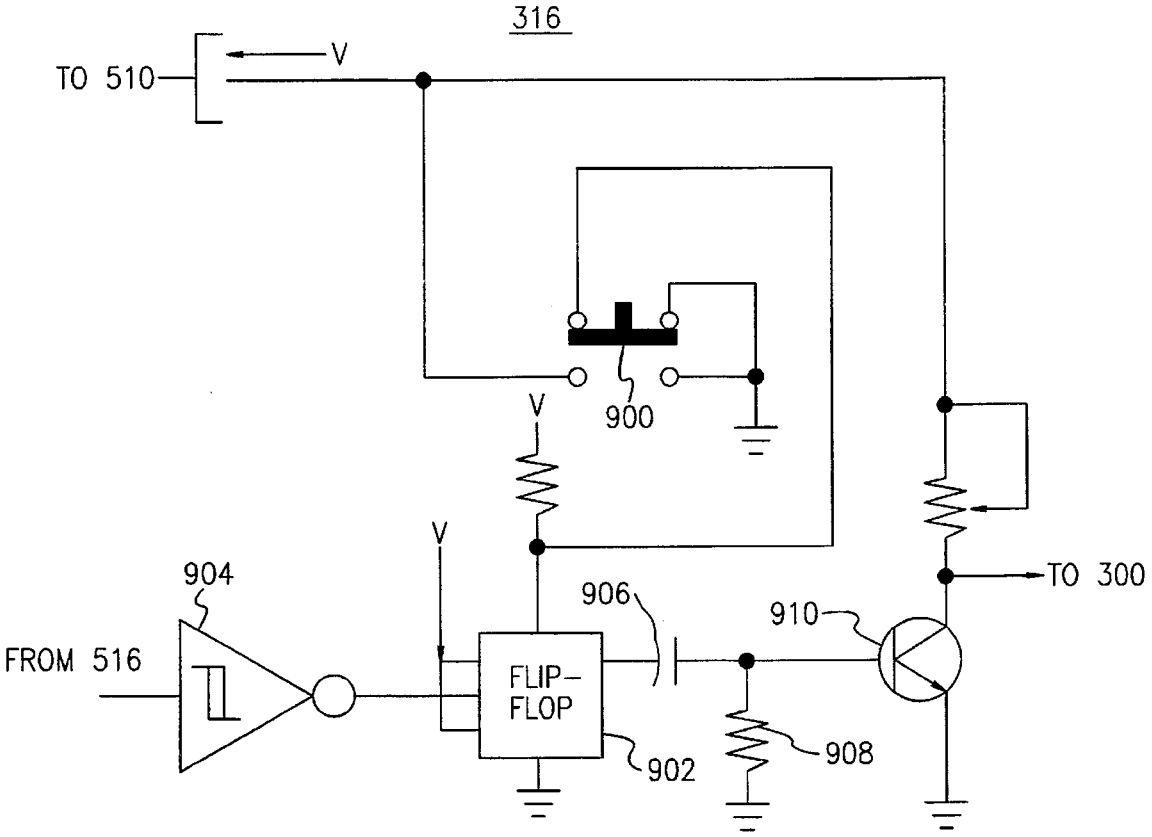
FIG. 9 illustrates the preferred structural form of the pendulum oscillation and time control employed in the third embodiment of FIG. 3*c.

In the case of the FIG. 3*c* third embodiment, the cooperative combination of magnetic field generator 304 and pendulum oscillation and time control 316 is shown in FIG. 5*e* together with FIG. 9.

Figure 4:
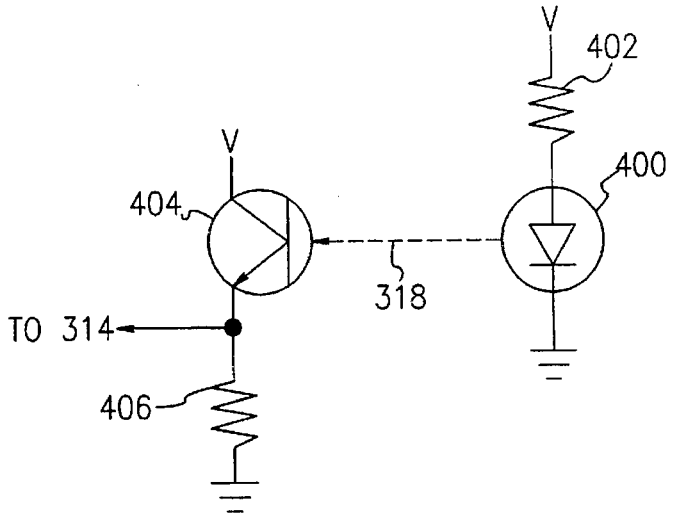
FIG. 4 illustrates an example of the structural form of the light emitters (i.e., LED) and light detectors (i.e., phototransistor) that may be employed in the embodiments of FIGS. 3*a*, 3*b* and 3*c* and that cooperate to detect an emitted light beam.

Referring to FIG. 4, there is shown a preferred embodiment of light emitter 308 and a preferred embodiment of light detector 312 which together cooperate to emit and detect light beam 318. As shown, light emitter 308 comprises light-emitting diode (L.E.D.) 400 energized by voltage V applied thereto through resistance 402. Preferably, L.E.D. 400 emits an infra-red light beam. Light detector 312 comprises an emitter follower circuit including phototransistor 404 and resistance 406 which is energized by voltage V.

Referring to FIG. 5*a*, the structurally simplest embodiment of the levitating magnet of magnetic field generator 304, in which the levitating magnet consists solely of electromagnet 500 energized by a sufficiently large current level from drive 314 to produce a magnetic field capable of levitating ball 310. However it is preferable to reduce the current requirements of drive 314 (and, hence, its cost) by employing the magnet means 502 shown in FIG. 5*b* (which is similar in operation to that disclosed in U.S. Pat. No. 3,937,148, issued Feb. 10, 1976) as the levitating magnet of magnetic field generator 304. As shown, magnet means 502 consists of electromagnet 504 in series with permanent magnet 506. While electromagnet 504 is energized by an insufficient current level from drive 314 to produce a magnetic field capable in itself of levitating ball 310, the resultant magnetic field produced by both electromagnet 504 and permanent magnet 506 is capable of levitating ball 310. For illustrative purposes only, each of both electromagnetic 500 and magnet means 502 is shown with its north pole (N) at the top and its south pole (S) at the bottom.

Referring to FIG. 5c, there is shown a species of magnetic field generator 304, comprising levitating magnet means 502 and, offset therefrom, a single auxiliary electromagnet 508. Auxiliary electromagnet 508, in response to a sinusoidal current applied thereto from sinusoidal signal generator 800, drives levitated pendulum ball 310 into forced oscillation. FIG. 5d shows an alternative species of magnetic field generator 304, comprising levitating magnet means 502 and, offset on opposite sides therefrom, auxiliary electromagnets 508a and 508b responsive to a sinusoidal current applied to each of them from sinusoidal signal generator 800 for driving levitated pendulum ball 310 into forced oscillation. In FIG. 5d, auxiliary electromagnets 508a and 508b are wound in opposite directions so that applying the same phase sinusoidal current from signal generator 800 to both of them results in the magnetic field produced by auxiliary electromagnet 508a being 180° out of phase with the magnetic field produced by auxiliary electromagnet 508b. The same result would apply to the case in which auxiliary electromagnets 508a and 508b are wound in the same direction, but opposite phase sinusoidal currents from signal generator 800 are applied to electromagnets 508a and 508b.

FIG. 5e, which is employed in the third embodiment of FIG. 3c, shows the case in which the resonant oscillation of pendulum ball 310 is used to provide clock time control. In this case, auxiliary electromagnet 510, which is offset from levitating magnet means 502, is energized by an intermittent pulse output from FIG. 9. The FIG. 5e species of magnetic field generator 304 also includes light emitter (L.E.) 512 for emitting a downward-directed vertical beam of light 514, which is situated between magnet means 502 and auxiliary electromagnet 510, and light detector (L.D.) 516, which is situated below oscillating pendulum ball 310 in a position to be illuminated by beam 514 except when oscillating pendulum ball 310 passes through beam 514, thereby interrupting the light reaching L.D. 516 and producing a pulse output from L.D. 516 which is applied as an input to FIG. 9.

Figure 5F:
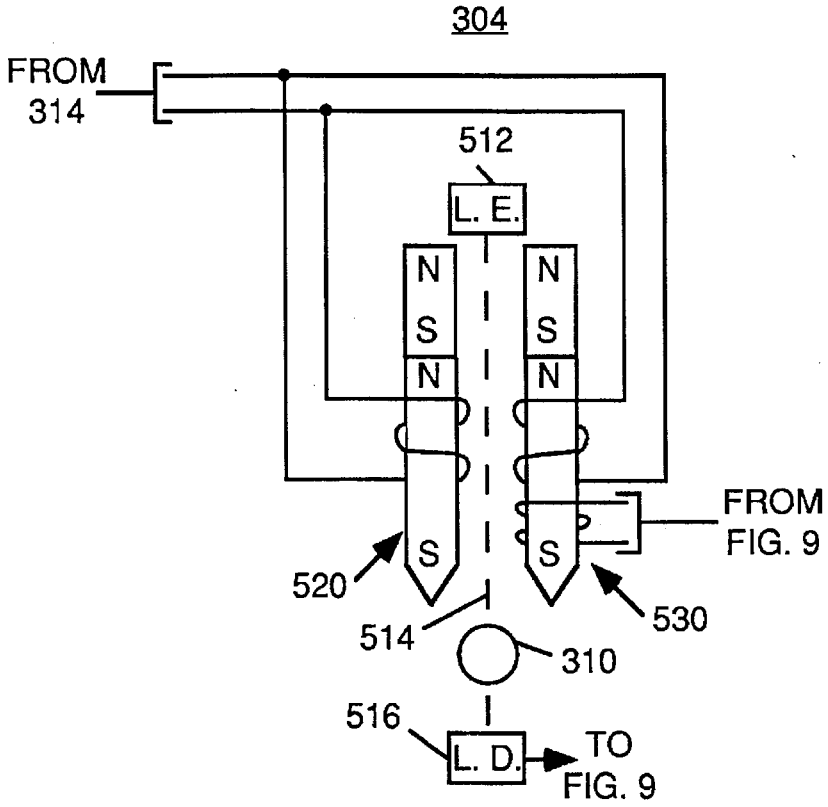

The FIG. 5f species, like the FIG. 5e species, is employed in the third embodiment of FIG. 3c of magnetic field generator 304. However, the FIG. 5f species provides an advantage over the FIG. 5e species. In particular, FIG. 5f uses two levitating magnet assemblies 520 and 530, which may be wired either in parallel (shown in FIG. 5f) or in series (not shown) to magnetic-field drive 314. One of the two levitating magnet assemblies (i.e., levitating magnet assembly 530 in FIG. 5f) includes an auxiliary winding energized from FIG. 9 for inducing lateral motion. The main advantage of the FIG. 5f species is that the the FIG. 5f species is capable of providing a longer horizontal pendulum swing and a longer oscillating period than the FIG. 5e species. The oscillatory period of the FIG. 5f species is primarily a function of the physical separation between levitating magnet assemblies 520 and 530.

Figure 6:
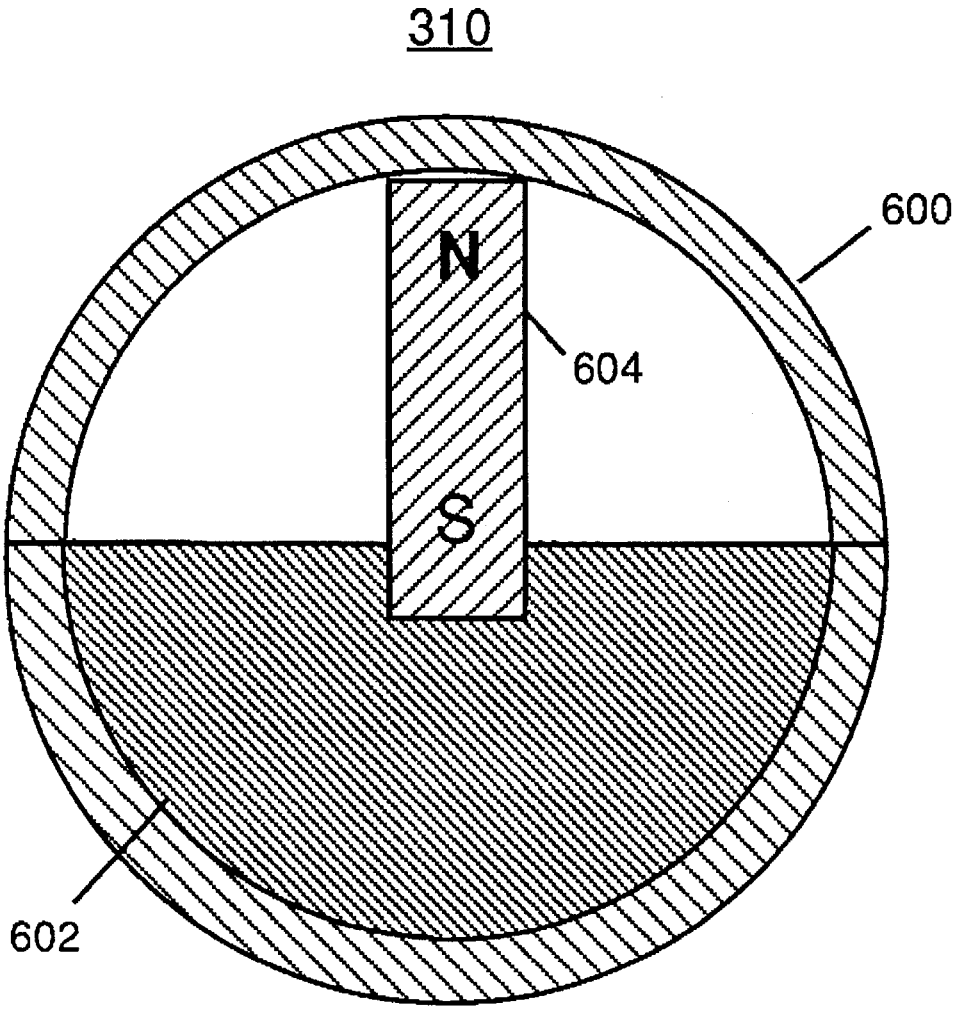
FIG. 6 illustrates an example of the structural form of the magnetically-levitated ball employed in the embodiments of FIGS. 3*a*, 3*b* and 3*c;*

Referring to FIG. 6, there is shown a preferred embodiment of the structure of oscillating pendulum ball 310. As shown, ball 310 comprises a spherical shell 600 having its lower interior hemisphere filled with a some material 602 which provides pendulum ball 310 with a low center of gravity. A permanent bar magnet 604 has its northern (N) pole in contact with the top of the interior surface of shell 600 and its southern (S) pole in contact with the top of material 602. When ball 310 is levitated by levitating magnet 500 or 502 or levitating magnet assemblies 520 and 530, the polarity of magnet 604 and the asymmetrical weighting of ball 310 by ferromagnetic material 602 substantially stabilizes the rotational position of ball 310 in the angular position shown in FIG. 6. Plastic or thin aluminum may be used for spherical shell 600 and epoxy or silicone may be used as material 602.

Figure 7A:
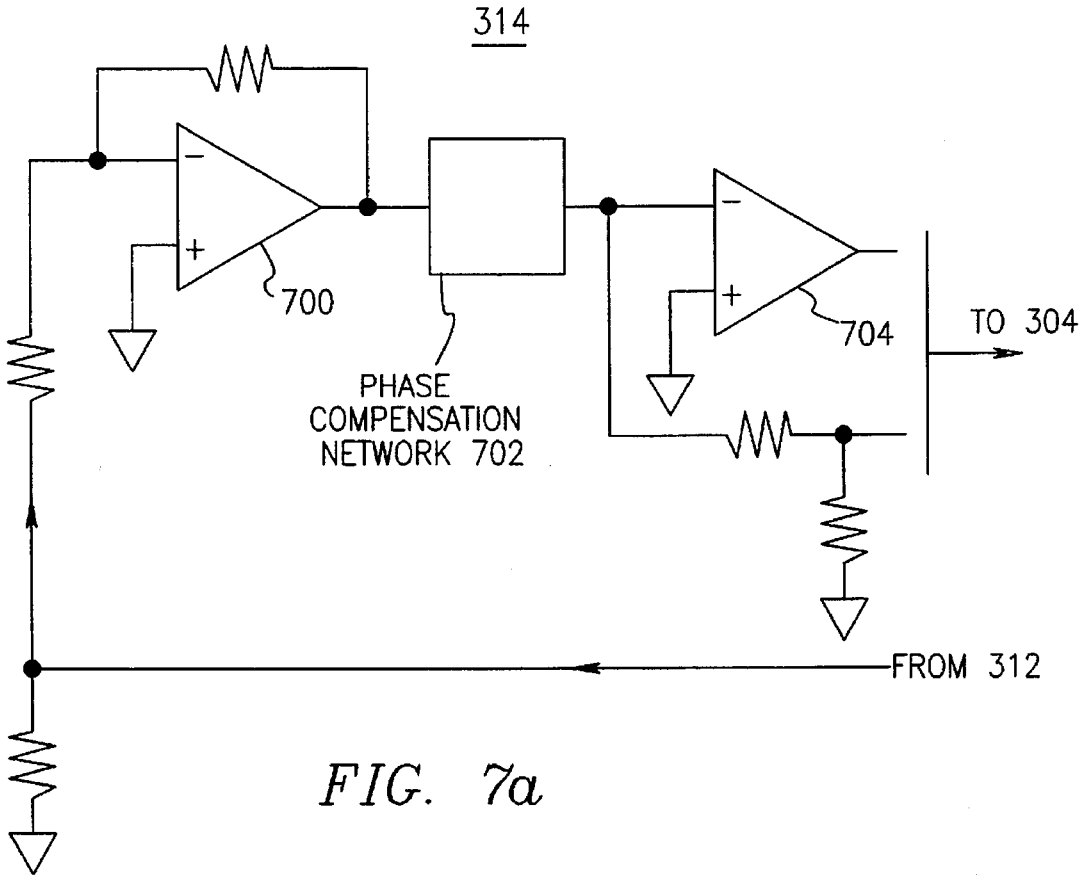
FIG. 7*a* illustrates a basic example of the structural form of the feedback-controlled, magnetic-field drive that employed in the embodiments of FIGS. 3*a*, 3*b* and 3*c;*

Referring to FIG. 7a, there is shown a basic example of the structure of feedback-controlled, magnetic-field drive 314 comprising operational amplifier 700, phase compensation network 702 and power operational amplifier 704. As indicated in FIG. 7a, the output from light detector 312 is fed back as an input to operational amplifier 700; the output from operational amplifier 700 is forwarded through phase compensation network 702 as an input to power operational amplifier 704. Power operational amplifier 704 supplies the energizing current to the levitating electromagnet 500 or 504 of magnetic field generator 304. If phase compensation network 702 were not present, an inherent time delay produced by the feedback path between light detector 312 and the levitating magnet might cause a destabilizing time delay to occur between the resulting changes in the strength of the levitating magnetic field due to changes in the output from light detector 312 when the position of pendulum ball changes. However, the presence of phase compensation network 702 overcomes this problem by providing an appropriate phase-compensating lead that insures that the levitating magnetic field remains stabilized with respect to such changes in the output from light detector 312.

Figure 7B:
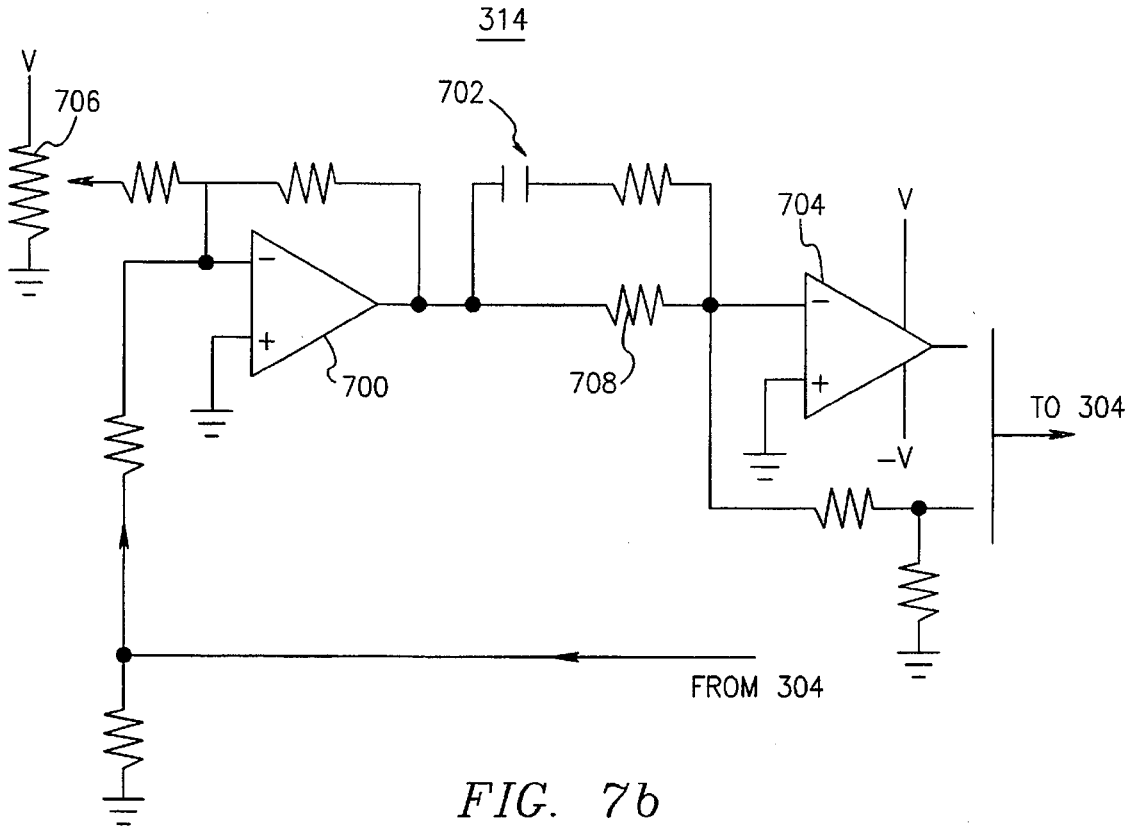
FIG. 7*b* illustrates the preferred structural form of the feedback-controlled, magnetic-field drive employed in the embodiments of FIGS. 3*a*, 3*b* and 3*c;*

Referring to FIG. 7b, there is shown a preferred embodiment of the structure of feedback-controlled, magnetic-field drive 314. Specifically, the quiescent level of the energizing current to the levitating electromagnet 500 or 504 of magnetic field generator 304 to determine the mean height of the levitated position of ball 310 within beam 318 is controlled by the setting of potentiometer 706. Operational amplifier 700, phase compensation network 702 and power operational amplifier 704 in FIG. 7b perform the same functions as in FIG. 7a, described above. In the case of FIG. 7b, phase compensation network 702 comprises resistance 708 bypassed by the capacitance 710 in series with resistance 712.

Referring to FIG. 9, there is shown a preferred embodiment of pendulum oscillation and time control 316 of FIG. 3c for both (1) periodically generating and applying energizing pulses to electromagnet 510 of FIG. 5e in accordance with the resonant frequency of pendulum ball 310 and (2) applying such pulses to clock mechanism 300 for use as the time control of clock mechanism 300. Specifically, momentary manual depression of switch 900 of FIG. 9 results in (1) flip-flop 902 being reset and (2) electromagnet 510 of FIG. 5e (which is offset from levitating magnet means 502 of FIG. 5e) being initially energized. This causes levitated ball 310 to be laterally pulled to the right, thereby causing ball 310 to momentarily interrupt beam 514 of FIG. 5e as it swings therethrough. While this results light detector (L.D.) 516 of FIG. 5e generating a first input pulse forwarded to FIG. 9, this first input pulse is without effect because flip-flop 902 is being maintained in its reset condition by depressed switch 900 at this time. However, when switch 900 is released, electromagnet 510 is deenergized, resulting in levitated ball 310 being laterally pulled back to the left by magnet means 502. This causes L.D. 516 to generate a second input pulse forwarded to FIG. 9 as ball again 310 momentarily interrupts beam 514. With switch 900 released, this second input pulse is operated on by Schmitt trigger 904, "divide-by-two" flip-flop 902 and a differentiating circuit comprising capacitance 906 and resistance 908 to derive a single pulse substantially isochronous with the second input pulse. This single pulse, after amplification by NPN transistor 910 is used to only momentarily reenergize electromagnet 510, causing ball 310 to oscillate back and forth through beam 314, in the manner described above to generate a pair of first and second pulses each of which is forwarded as an input to Schmitt trigger 904. However, the operation of "divide-by-two" flip-flop 902 permits only the second pulse of the pair to be forwarded as the single pulse input to transistor amplifier 910. In this manner, the above described reenergization of electromagnet 510 is continually repeated to provide continuous oscillation of ball at the resonant frequency of ball 310 which results in the derivation of a periodic series of pulses at the output of transistor 910. This periodic series of pulses, besides being employed to reenergize electromagnet 510, is also applied as a time control to clock mechanism 300. Further, as discussed in more detail below, the resonant frequency of pendulum ball 310 substantially corresponds with simple harmonic motion thereof.

Operation of each of the above-described first, second and third embodiments of FIGS. 3*a*, 3*b* and 3*c*, respectively, will now be considered. For illustrative purposes, it is assumed in all cases that (1) that the clock takes the form of either the analog clock shown in FIG. 1 or the digital clock shown in FIG. 2; (2) the levitating magnet takes the form of levitating magnet 502 shown in FIGS. 5*b*, 5*c*, 5*d* and 5*e*, and (3) the pendulum takes the form of the magnetized pendulum ball 310 shown in FIG. 6.

To start with, magnetized pendulum ball 310 must be placed within the magnetic field of levitating magnet 502. This may be accomplished by hand by holding the pendulum ball (112 in FIG. 1 or 212 in FIG. 2) with its north (N) pole on top within the light beam (e.g., cylindrical light beam 318 in FIGS. 3*a*, 3*b* and 3*c*) substantially midway between the light emitter (114 in FIG. 1 or 214 in FIG. 2) and the light detector (116 in FIG. 1 or 216 in FIG. 2) and then letting go. The antagonistic downward force of gravity and the upward force of the magnetic field of levitating magnet 502 on the pendulum ball result the pendulum ball assuming an equilibrium vertical position within light beam 318 which is maintained by feedback-controlled, magnetic-field drive 314 controlling the magnitude of the magnetizing current supplied to levitating magnet 502. Alternatively, a pedestal may be used to place the magnetized pendulum ball within the magnetic field of levitating magnet 502. In this case, the pendulum ball is disposed on a pedestal (which may be similar in shape to a golf tee), with its north(N) pole on top, so that it is situated slightly below its equilibrium vertical position within light beam 318. The levitating magnetic field then causes the magnetized pendulum ball to move up and off the pedestal to its equilibrium vertical position within light beam 318.

In the first and second embodiments of FIGS. 3*a* and 3*b*, the operation causing lateral oscillation of magnetized pendulum ball 310 is straight forward. The resultant of the levitating magnetic field and the magnetic field generated by sinusoidal current from signal generator 800 of FIG. 8 applied either to single electromagnet 508 of FIG. 5*c* or to the double electromagnets 508*a* and 508*b* of FIG. 5*d* drives magnetized pendulum ball 310 into forced lateral oscillation at the frequency of the applied sinusoidal current. In the case of the the first embodiment of FIG. 3*a*, in which sinusoidal signal generator 800 is free running, the oscillation frequency is independent of time control element 302 (e.g., quartz crystal) of clock mechanism 300. However, in the case of the the second embodiment of FIG. 3*b*, in which sinusoidal signal generator 800 is synchronized by time control element 302, the oscillation frequency is determined by time control element 302 of clock mechanism 300.

In the third embodiment of FIG. 3*c*, after the momentary depression of start switch 900 of FIG. 9 is completed, electromagnet 510 of FIG. 5*e* is only momentarily energized by a current pulse from FIG. 9 during each cycle of lateral oscillation of magnetized pendulum ball 310, while levitating magnet means 502 is continuously energized by feedback-controlled, magnetic-field drive 314. The result is that the cooperative operation of above-described FIGS. 5*e* and 9 causes substantially simple harmonic motion of magnetized pendulum ball 310. Specifically, the levitating magnetic field supporting laterally oscillating magnetized pendulum ball 310 has a vertical upward component which is nearly constant at all times regardless of the horizontal position of the ball 310. In this way, the weight of the ball 310 is counterbalanced. This permits ball 310 to swing on a nearly perfect horizontal line aligned with light beam 318.

The horizontal magnetic field, by comparison, is quite dynamic. It is zero when ball 310 is just beneath magnet 502 and it is at a maximum when ball 310 is at left or right furthest horizontal excursion. The horizontal magnetic field component is analogous to a mechanical spring under compression. When ball 310 is just beneath magnet 502, it corresponds to a completely relaxed spring. As ball 310 moves to one side, it corresponds to the stretching of the spring. This results in a resisting force, like that of a stretched spring, to be offered to the inertia of ball 310. Eventually, this resisting force overcomes the inertia of ball 310, causing ball 310 to reverse direction. In this way, ball 310 oscillates in a manner that corresponds to that of a spring-mass oscillator.

The relationship between the feedback-controlled magnetic-field drive 314 and the vertical magnetic field component on a micro scale will now be considered. As ball 310 moves slightly in the horizontal direction from a position just beneath magnet means 502, the effective distance between ball 310 and magnet means 502 increases. This increased separation causes the magnetic field strength to drop. As a result, ball 310 begins to fall. Almost immediately, however, the output from light detector 312 increases. This causes a high magnet current in magnet means 502, resulting in an increased magnetic field strength. This, in turn, lifts falling ball 310, thereby substantially restoring ball 310 to its original vertical position. Such corrections are continuously and automatically made by feedback-controlled magnetic-field drive 314 as ball 310 swings back and forth. In this way, feedback-controlled magnetic-field drive 314 constrains ball 310 to the line of light beam 318.

Further, it can be mathematically shown that the lateral oscillating frequency of ball 310 is substantially solely proportional to the distance between magnet means 502 and ball 310 (i.e., the oscillating motion of pendulum ball 310 is substantially simple harmonic motion).

Further, any tendency for levitated pendulum ball 310 to move out of cylindrical light beam 318 in a direction normal to the direction of oscillation (i.e., in a direction normal to the plane of the paper in FIGS. 3*a*, 3*b* and 3*c*) will also be counteracted by the levitating magnetic field assuming a horizontal restoring component in the direction normal to the direction of oscillation. Thus, levitated oscillating pendulum ball 310 remains stably within cylindrical light beam 318.

Figure 10C:
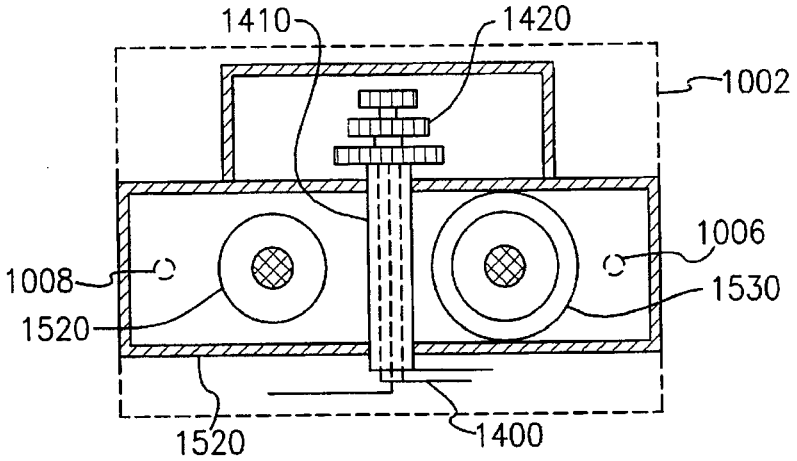
* and FIGS. 10*a*, 10*b* and 10*c* together illustrate the preferred internal structure of the analog clock of FIG. 1 using a structural form similar to the magnetic field generator shown in FIG. 5*f*.
Figure 10A:
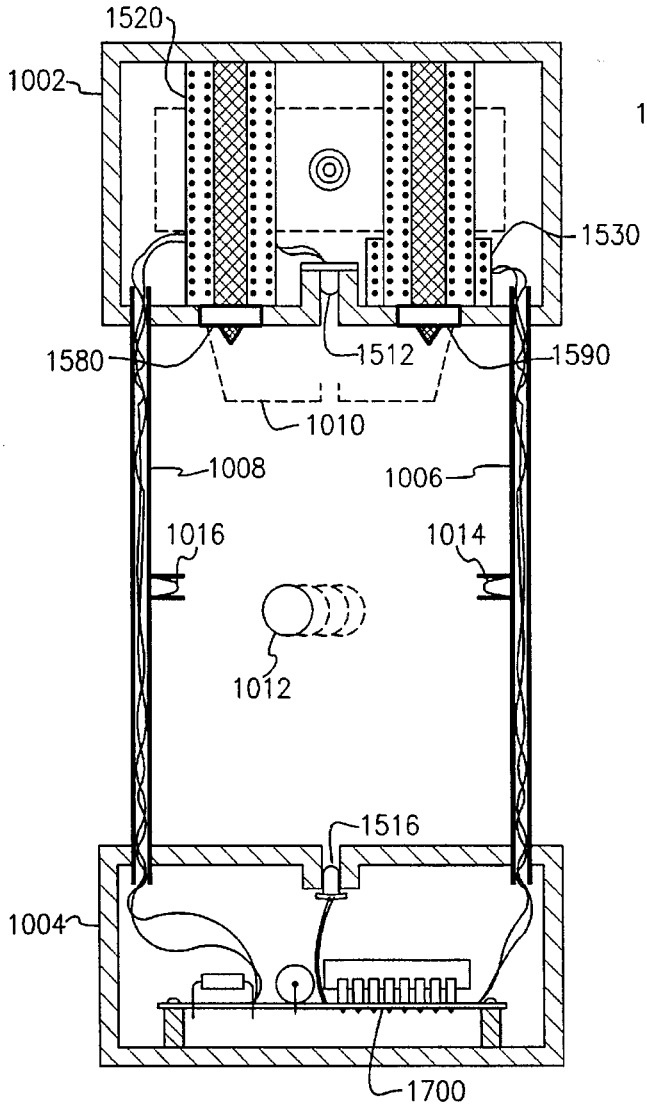
Figure 10B:
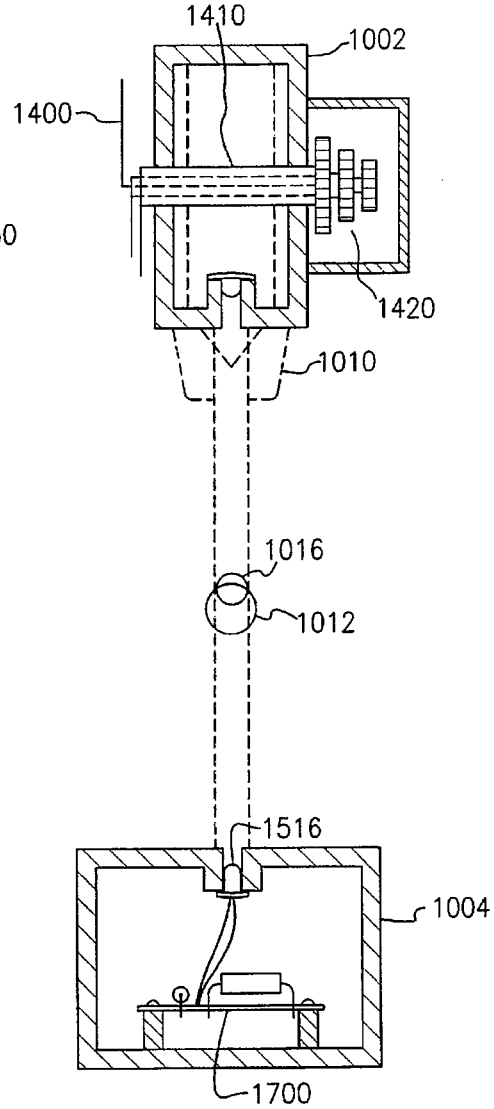

As a preferred example of the present invention, FIGS. 10*a*, 10*b* and 10*c*, respectively, show front, side and top cut away views of the analog clock of FIG. 1, that make substantial use the FIG. 5*f* species of magnetic field generator 304. As discussed above, the FIG. 5*f* species of magnetic field generator 304 provides a wide pendulum swing. This permits the clock timing to be easily adjusted by changing the spacing between magnet assemblies 1520 and 1530, shown in FIGS. 10*a* and 10*b*. However, magnet assemblies 1520 and 1530 differ in structure from magnet assemblies 520 and 530 of FIG. 5*f* by employing permanent magnets 1580 and 1590 located near the bottom tips of magnet assemblies 1520 and 1530 (rather than near the top, as in FIG. 5*f*). Preferably, permanent magnets 1580 and 1590 are made of thin disk-shaped high-energy material, such as rare earths. Because permanent magnets 1580 and 1590 are placed at the bottom tip, the size of permanent magnets 1580 and 1590 can be significantly reduced because their effectiveness in contributing to the magnetic field operating on ball 1012 is greatly enhanced. This results in a lower cost clock.

FIGS. 10*b* and 10*c* show clock mechanism 1420, which is a standard gear box and stepper motor assembly found in the common low-cost analog quartz wall clock for the home. However, unlike the common wall clock, extended hour, minute and second shafts 1410 (concentric geometry) are provided for moving the clock hands 1400. With this arrangement, a low-profile clock face is possible. Extension shafts 1410 nicely fit through magnet assemblies 1520 and 1530.

Electronics 1700, shown in FIGS. 10*a* and 10*b*, are housed in the bottom of base 1004 of the clock. Printed circuit (PC) board construction is used. Power would be provided by a small A.C. wall transformer external to the clock.

The light emitters/detectors 1014, 1016, 1512 and 1516 all use light baffles to block out ambient light. The intensity of the emitters is designed to be high so as to be well above room light levels. In this way, the light emitters/detectors may operate reliably in room light conditions. Under extreme lighting conditions, such as exposure to sunlight, it is possible to A.C. modulate the LED light emitters and to employ known A.C. detection techniques in the phototransistor light detectors to discriminate between the desired LED light and the undesired ambient light.

The remaining elements shown in FIGS. 10*a*, 10*b* and 10*c* are listed below.

| | |
|---|---|
| 1002 | Clockwork housing |
| 1006, 1008 | Tubular support rods for holding the clock assembly. Wires are easily passed through the tubes for interconnections. |
| 1010 | Magnet housing |
| 1012 | Ferromagnetic ball pendulum |

In all of the preceding embodiments, the levitated pendulum is in the shape of a ball, but this is not essential. The levitated pendulum may have other shapes, such as a disk, for example. Further, for ornamental purposes, it is possible to modify the first and second embodiments of FIGS. 3*a* and 3*b* (in which the driven oscillation of the pendulum is forced) so that the levitated pendulum oscillation is other than lateral. By way of examples, the levitated pendulum oscillation may be (1) torsional, (2) "see saw" or (3) vertical.

The torsional oscillation case may be implemented by employing a levitated pendulum comprising a lower horizontal cross piece having a pair of relatively small permanent bar magnets respectively mounted at its left and right ends and a relatively large permanent bar magnet mounted at its center and rising upward toward magnetic means 502 (with the top of this relatively large permanent bar magnet intercepting cylindrical light beam 318). Situated within base 104 of FIG. 1 or base 204 of FIG. 2 is a turntable having a pair of permanent magnets mounted thereon in cooperative relationship with the relatively small permanent bar magnets respectively mounted at its left and right ends of the lower horizontal cross piece of the levitated pendulum. The turntable is mounted on a motor mechanism that rotates it back and forth through a given angle, causing the levitated pendulum to rotate back and forth in synchronism therewith.

The "see saw" oscillation case may be implemented by employing a pair of levitating magnetic means that are laterally displaced from one another by a given distance and a levitated pendulum comprising a cross piece having a length substantially equal to the given distance with a pair of permanent bar magnets respectively mounted at each of its ends. By alternately increasing and then decreasing the current through one of the displaced levitating magnetic means while alternately decreasing and then increasing the current through the other of the displaced levitating magnetic means, the cross piece will rock up and down in a see-saw motion.

A vertical levitated pendulum oscillation may be implemented by employing a Hall effect magnetic field position sensor in accordance with the teachings of U.S. Pat. No. 4,910,63, issued to Quinn on Mar. 20, 1990, to control the alternately increasing and then decreasing strength of the levitating magnetic field and, hence, the oscillating vertical position of the pendulum.

I claim:

1. In an article of manufacture comprising a pendulum clock; the improvement wherein:

said pendulum is a physically-detached, magnetically-levitated, oscillating pendulum comprising a ferromagnetic material; and said pendulum clock employs feedback-controlled magnetic field drive means for controlling levitation of said pendulum.

2. The article of manufacture defined in claim 1, wherein said pendulum clock comprises:

a magnetic-field generator comprising levitating magnet means including a levitating electromagnet, said levitating magnet means being positioned to apply a substantially upward component of force on said levitated pendulum in accordance with the magnitude of a drive current applied to said levitating electromagnet;

substantially horizontally displaced light emitter and light detector means, said pendulum being positioned within a substantially horizontal light beam having a given cross section generated by said light emitter and directed toward said light detector so that said pendulum partially occludes said light beam reaching said light detector; and feedback, controlled, magnetic-field drive means for controlling the magnitude of said drive current applied to said levitating electromagnet in accordance with of said light detector's output magnitude to cause said levitated pendulum to assume a vertical position within said cross section of said light beam in which said upward component of force on said levitated pendulum is equal to the downward gravitational force on said levitated pendulum.

3. The article of manufacture defined in claim 2, wherein:

said levitating magnet means further includes a permanent magnet.

4. The article of manufacture defined in claim 1, wherein:

wherein said levitated pendulum comprises a permanent magnet.

5. The article of manufacture defined in claim 1, wherein said pendulum clock comprises:

pendulum oscillation control means for driving said levitated pendulum into forced oscillation at a frequency determined by said pendulum oscillation control means; and a time control element for determining the timing of said clock.

6. The article of manufacture defined in claim 5, wherein:

said pendulum oscillation control means is (1) decoupled from said time control element and (2) operates at a frequency which is independent of said time control element.

7. The article of manufacture defined in claim 5, wherein:

said pendulum oscillation control means is (1) coupled to and synchronized by said time control element and (2) operates at a frequency which is determined by said time control element.

8. The article of manufacture defined in claim 5, wherein:

said pendulum oscillation control means includes lateral-oscillation means for driving said levitated pendulum into lateral oscillation.

9. The article of manufacture defined in claim 8, wherein:

said lateral-oscillation means includes a free-running sinusoidal signal generator for determining the lateral frequency of oscillation of said levitated pendulum.

10. The article of manufacture defined in claim 8, wherein:

said lateral-oscillation means includes a sinusoidal signal generator coupled to and synchronized by said time control element for determining the lateral frequency of oscillation of said levitated pendulum.

11. The article of manufacture defined in claim 5, wherein:

said time control element includes a quartz crystal for determining the timing of said clock.

12. The article of manufacture defined in claim 1, wherein said pendulum clock comprises:

pendulum oscillation and time control means for maintaining said levitated pendulum laterally oscillating at a resonant frequency of said pendulum and for determining the timing of said clock in accordance with said resonant frequency of said pendulum.

13. The article of manufacture defined in claim 12, wherein said pendulum clock further comprises:

means including a magnetic field generator positioned to maintain said pendulum levitated at substantially a given vertical distance below the position of said magnetic field generator, wherein said magnetic field generator includes levitating magnet means and an auxiliary electromagnet horizontally displaced a given distance from said levitating magnet means.

14. The article of manufacture defined in claim 13, wherein said said pendulum oscillation and time control means further comprises:

start switch means for momentarily energizing said auxiliary electromagnet to initiate lateral oscillation of said pendulum at its resonant frequency;

pendulum position detection means horizontally situated in between said displaced levitating magnet means and said auxiliary electromagnet for detecting said levitated pendulum moving passed said pendulum position detection means;

auxiliary electromagnet energizing means responsive to the detected output of said pendulum position detection means for generating a pulse in response to said levitated pendulum moving in a given direction passed said pendulum position detection means, whereby successive pulses are generated at the resonant frequency of said levitated pendulum; and coupling means for applying each of said successive pulses (1) to said auxiliary electromagnet to effect momentary energization thereof, and (2) as a time control to said clock for determining the timing of said clock;

whereby the lateral movement of said levitated pendulum is substantially simple harmonic motion to thereby provide a resonant frequency for said levitated pendulum which depends substantially solely on said given vertical distance.

15. The article of manufacture defined in claim 1, wherein:

said levitated pendulum comprises a permanent magnet.

16. The article of manufacture defined in claim 15, wherein:

said levitated pendulum is shaped as a ball.

17. The article of manufacture defined in claim 1, wherein:

said levitated pendulum is shaped as a ball.

18. The article of manufacture defined in claim 1, wherein:

said pendulum clock is an analog pendulum clock.

19. The article of manufacture defined in claim 1, wherein:

said pendulum clock is a digital pendulum clock.

* * * * *